United States Patent [19]

Korpela

[11] Patent Number: 4,854,654

[45] Date of Patent: Aug. 8, 1989

[54] COLLAPSIBLE CABINET

[75] Inventor: Jaakko Korpela, Savonlinna, Finland

[73] Assignee: Proxy Oy, Helsinki, Finland

[21] Appl. No.: 64,945

[22] PCT Filed: Oct. 1, 1986

[86] PCT No.: PCT/FI86/00103

§ 371 Date: Jun. 2, 1987

§ 102(e) Date: Jun. 2, 1987

[87] PCT Pub. No.: WO87/01917

PCT Pub. Date: Apr. 9, 1987

[30] Foreign Application Priority Data

Oct. 3, 1985 [FI] Finland ..... 853828
Oct. 3, 1985 [FI] Finland ..... 853829

[51] Int. Cl.[4] ..... A47B 43/00

[52] U.S. Cl. ..... 312/265.1; 312/264; 403/354

[58] Field of Search ..... 312/257 R, 257 SK, 257 SM, 312/257 A, 263, 264, 265, 108; 403/354

[56] References Cited

U.S. PATENT DOCUMENTS

| | | | |
|---|---|---|---|
| 1,487,856 | 3/1924 | Hauserman et al. | 312/257 R X |
| 1,958,686 | 5/1934 | Vanderhoof | 312/257 R X |
| 3,796,503 | 3/1974 | Dawson | 403/354 X |
| 3,892,189 | 7/1975 | Killam | 312/257 SK X |
| 4,045,104 | 8/1977 | Peterson | 312/263 X |
| 4,191,436 | 3/1980 | Cherry | 312/257 SK X |
| 4,270,822 | 6/1981 | Gusdorf | 312/265 |
| 4,536,044 | 8/1985 | Ziegelheim et al. | 312/263 X |
| 4,632,473 | 12/1986 | Smith | 312/257 SK |

FOREIGN PATENT DOCUMENTS

| | | | |
|---|---|---|---|
| 2609619 | 9/1977 | Fed. Rep. of Germany | 312/263 |
| 2701969 | 7/1978 | Fed. Rep. of Germany | 312/257 R |
| 3003818 | 8/1981 | Fed. Rep. of Germany . | |
| 3333636 | 4/1985 | Fed. Rep. of Germany | 312/257 R |
| 26697 | 6/1954 | Finland . | |
| 55108 | 6/1979 | Finland . | |
| 64227 | 10/1983 | Finland . | |
| 925976 | 9/1947 | France | 312/257 R |
| 986340 | 7/1951 | France | 312/257 R |
| 1109125 | 1/1956 | France | 312/257 SK |

*Primary Examiner*—Peter A. Aschenbrenner
*Assistant Examiner*—Thomas A. Rendos
*Attorney, Agent, or Firm*—Lorusso & Loud

[57] ABSTRACT

The invention relates to a collapsible cabinet, comprising end ladder structures (3) on the gables of a cabinet and door frame structures. Both of these structures include upright posts (7) and horizontal braces (9) therebetween, the latter being fastened between the upright posts by means of screws (15) extending through said upright posts. Horizontal braces (9) and upright posts (7) define rectangular areas, the sides of horizontal braces and upright posts facing said areas being provided with a groove (13, 14) for receiving cover boards which cover such areas. The broad sides of upright posts (7) of end ladder (3) are placed against the ends of horizontal braces (9) and provided with two arrays of holes (16) extending on either side of the ends of horizontal braces (9).

8 Claims, 4 Drawing Sheets

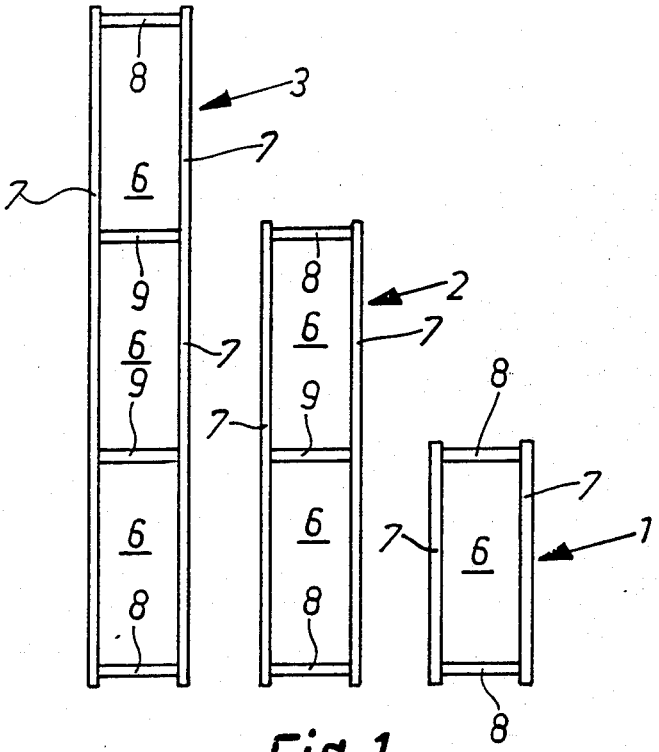
Fig. 1
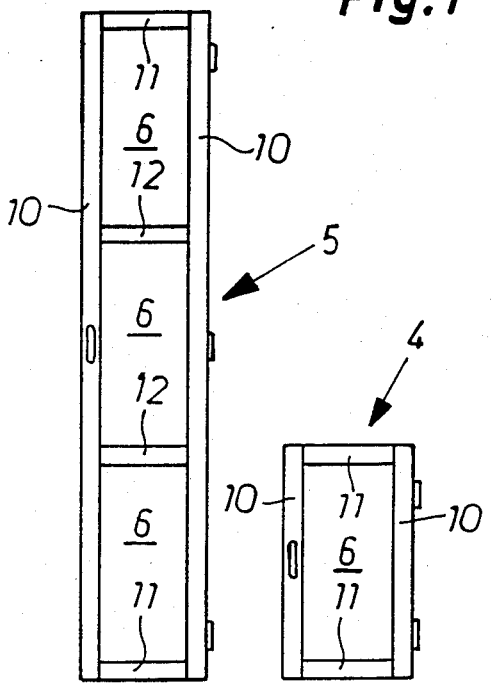
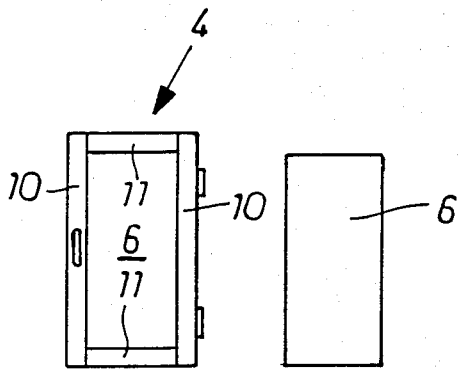
Fig. 2
Fig. 3

COLLAPSIBLE CABINET

The present invention relates to a collapsible cabinet, comprising end ladder structures mounted on the gables of said cabinet and door frame structures, both structures including upright posts and horizontal braces therebetween, the latter being fastened between the upright posts for keeping said upright posts parallel to and spaced from each other, the horizontal braces and upright posts thus defining rectangular areas, whereby the sides of horizontal braces and upright posts facing such areas are provided with a groove for receiving cover boards that cover said areas.

An advantage offered by this type of cabinet is that it can be manufactured by using relatively few standard elements and assembled readily and quickly on site. Another advantage is that a variety of cabinet designs can be assembled by using a relatively limited selection of elements.

In the prior art cabinets, only some of these advantages are achieved since the end ladders as well as cabinet doors have generally been prefabricated, which means that their price is relatively high and their size imposes certain limitations to the reduction of the size of a shipping package. Variation possibilities are also limited.

An object of the invention is to develop a cabinet of the above type further, so that the end ladders and doors can also be assembled readily and quickly from prefabricated elements and that the number of various elements can be further decreased while, at the same time; providing flexible and extensive variation possibilities for assembling various types of cabinets from few prefabricated, extremely simple basic elements.

In order to achieve this object, a cabinet of the invention is characterized in that the horizontal braces of end ladders are fastened between the broad sides of upright posts by means of screws extending through said upright posts, in addition to which the broad sides of upright posts are provided with arrays of holes, extending on either side of the ends of horizontal braces. The doors are also assembled by fastening the horizontal braces by means of screws extending through the upright posts. A particularly preferable embodiment of the invention is characterized in that the rectangular area defined by the bottom of said grooves is of equal size in the end ladder and in the door frame structure, both of said areas being fitted with cover boards of a single standard size.

The cover boards for end ladders and doors can be prefabricated from the same type of board in one standard size, the only variable being the colour.

Another object of the invention is take advantage of the special structure of an end ladder in a manner that various supports and fasteners, such as support and runner tracks for drawers, door hinges, clothes hanging rods and hooks and the like, can be mounted in a simple manner, quickly and readily in their desired positions, which positions can be freely chosen in vertical direction.

In order to achieve this object, a fastening assembly of the invention is characterized in that said supports or fasteners are secured to or formed integrally with a fastening piece, whose ends are provided with holes or recesses for inserting therein the pegs fitting in the holes of said arrays of holes.

The invention will now be described in more detail with reference made to the accompanying drawings, in which FIG. 1 shows an end ladder structures in three different sizes, FIG. 2 shows a cabinet door in two different sizes, and FIG. 3 shows a single standard size cover board for use in end ladders and doors.

Figure 4:
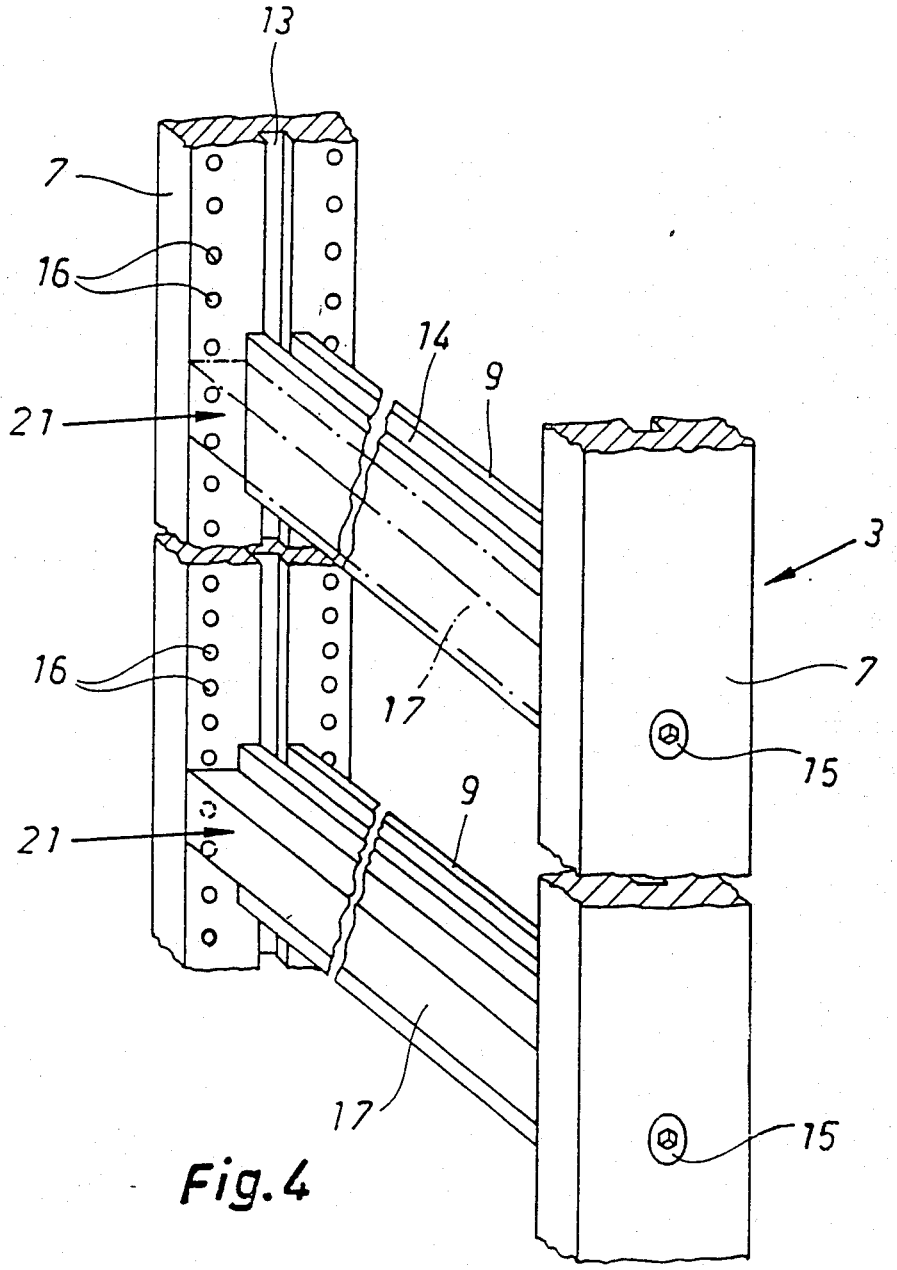
FIG. 4 is a perspective view to a larger scale of the cut-away portion of an end ladder at a horizontal brace and FIG. 5 is a perspective view of the opposite ends of a fastening piece.
Figure 6:
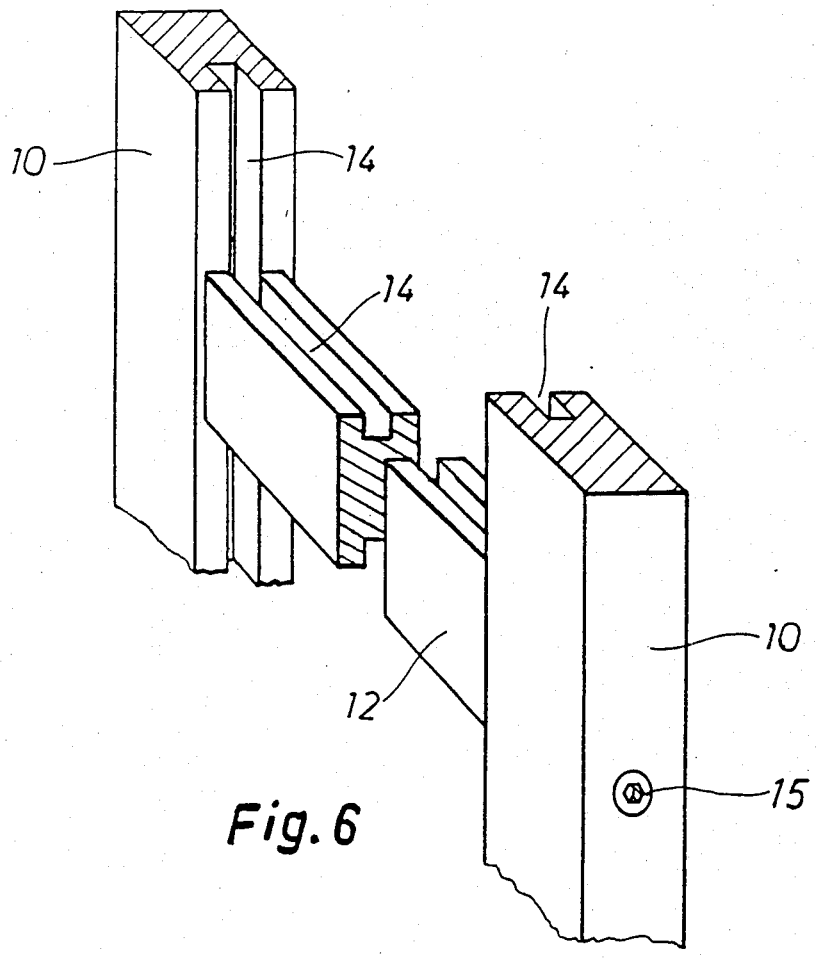
FIG. 6 is a perspective view of the cut-away portion of a door frame structure at a horizontal brace.

Referring to FIG. 1, end ladders 1, 2 and 3 for the gables of a cabinet all comprise upright posts 7, which are similar to each other but of different lengths and fixed at a distance from each other by means of horizontal braces 9, shown more closely in FIGS. 4 and 6. The top and bottom horizontal braces 8 only differ from horizontal braces 9 by having a groove 14 on just one side. Upright posts 7 and horizontal braces 8, 9 are provided with grooves 13 and 14 for receiving the edges of cover boards 6. Upright posts 7 are provided with prefabricated holes for fastening screws 15 for securing said upright posts 7 to the ends of horizontal braces 9. The fastening holes of screws 15 are spaced a standard distance from each other, the distances between horizontal braces 8 and 9 being thus also equal in all cases. The bottoms of grooves 13 and 14 define a rectangular area which substantially matches the size of a cover board 6.

In addition, the broad inner sides of upright posts 7 are provided with vertical arrays of holes 16 adjacent to the edges. Since the lateral direction of horizontal braces 8, 9 extends in vertical direction, said arrays of holes 16 remain free also at the ends of the horizontal braces. The arrays of holes 16 serve to receive metal pegs, upon which pegs it is possible to mount shelves (not shown) to be placed inside the cabinet. The arrays of holes 16 have also other purpose in this invention, as explained later.

As for their general structural principle, the door frame structures 4 and 5 correspond to the end ladder structures. The most significant difference is that the broad sides of upright posts 10 are parallel to horizontal braces 11 and 12, the thickness of a door frame remaining sufficiently small. Also in this case, said upright posts 10 are provided with prefabricated holes and horizontal braces 11, 12 can be fixed at a standard distance from each other by means of screws 15 inserted through said holes.

Figure 7:
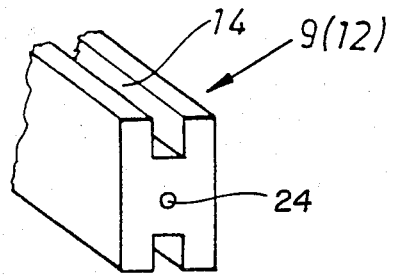
FIG. 7 is a perspective view of the end of a horizontal brace.

Even the ends of horizontal braces g (12) can be provided with pre-drilled holes 24 (FIG. 7) for sufficient dimensional precision in the position of horizontal braces. The distances between the fastening holes of screws 15 in upright door posts 10 are equal to those in upright end ladder posts 7.

Since grooves 14 in upright door posts 10 are deeper than those 13 in upright end ladder posts 7, said horizontal braces 11, 12 used in doors are slightly shorter than end ladder horizontal braces 8, 9. For the reasons of strength and appearance, the width and thickness of door frame elements 10, 11, 12 can be chosen to be different from those of end ladder elements 7, 8, 9.

An essential feature is that also the rectangle defined by grooves 14 in the door frame structure is adapted to receive the same cover boards 6 as the rectangle defined by grooves 13, 14 in the end ladders. All boards 6 can be cut from the same material, whereby they can come in several different colours, e.g. white, black, blue, red, grey etc. One possible material for board 6 is also glass.

Next described is the use of arrays of holes 16 for various supporting duties.

Figure 5:
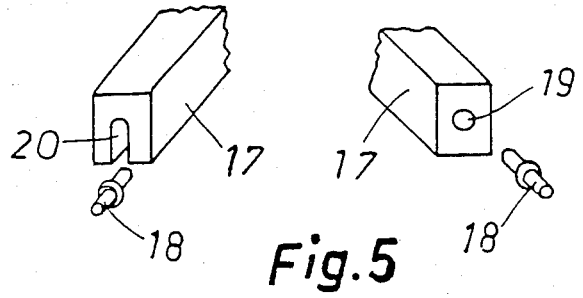

FIGS. 4 and 5 illustrate fastening pieces 17, placed between the perforated sides of upright posts 7 and usable for fastening door hinges, clothes hooks, clothes hanging rods and the like. As shown in FIG. 5, one end of a fastening piece 17 is provided with a hole 19 and the other end with a groove or recess 20, open on its bottom side. Pegs 18 are inserted in the holes of the arrays of holes 16 in upright posts 7, e.g. at a height suitable for fixing a hinge. The end of fastening piece 17 fitted with a hole 19 is first inserted into peg 18 followed by dropping the end with laterally open recessed area 20 in it in position on top of a peg 18 mounted on the other upright post 7. Hinges can be mounted beforehand on cabinet doors and fastening pieces 17. This makes the fixing of hinges and mounting of doors essentially easier than it would be if a hinge was fixed directly to the solid frame structures of a cabinet.

Pegs 18 can be e.g. metal pegs and there is a widening in the middle to determine the depth to which pegs 8 are inserted in holes 16.

In the present case, fastening pieces 17 are mounted on the sides of horizontal braces 9 so that they lean against the side face of horizontal braces 9. Thus, fastening pieces 17 are not able to twist or turn, even though their ends are supported by just one peg 18.

An end ladder 1, 2 or 3 together with its cover board 6 forms a solid gable for a cabinet. Between two such gables there is mounted a door or double-doors, closing the front of a cabinet partly or completely. The two hinges of each door are secured to an end ladder structure at spots indicated by reference numeral 21, the door thus finding its position adjacent to an upright post 7 parallel to the broad sides of said upright post.

Figure 8:
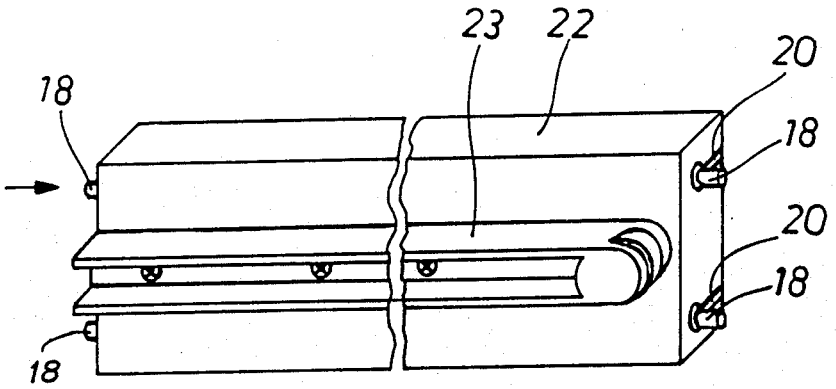
FIG. 8 is a perspective view of a fastening piece for the support and runner track of a drawer and FIG. 9 is a perspective view of an end ladder structure for a cabinet or an array of shelves, fitted with fastening pieces shown in FIG. 8.

FIG. 8 illustrates a fastening piece 22, whose length substantially matches the distance between the perforated sides of upright posts 7. Mounted on the surface of fastening piece 22, e.g. by means of screws, is a support and runner track 23 for a drawer. Said runner track 23 can be made e.g. of plastics and one end of it may be fitted with a roller for facilitating drawer sliding. It is obvious that all types of support and runner tracks can be used. A support and runner track may even be a track-like protrusion in fastening piece 22.

One (left-hand) end of fastening piece 22 is provided with two holes, the distance between pegs 18 inserted in those holes corresponding to the distance between holes 16. Pegs 18 are e.g. metal pegs which have a widening in the middle to determine the depth to which pegs 18 are inserted into the holes at the end of fastening piece 22.

The other (right-hand) end of fastening piece 22 is provided with two laterally open recessed area 20 for receiving the other ends of said pegs 18, which are already inserted in holes 16, as said piece 22 is turned sideways. When the drawer is stationary, said pieces 22 are not able to turn so that pegs 18 would slip out of recessed areas 20.

A fastening piece 22 as shown in FIG. 8 can be fitted in a desired position between upright posts 7 by first positioning the end of piece 22 carrying pegs 18 in place, by inserting pegs 18 in the holes 16 in another upright post aligned with recessed areas 20 and by finally turning piece 22 in a manner that recessed areas 20 find their way to pegs 18 mounted on upright post 7.

The horizontal thickness of fastening piece 22 is chosen to be smaller than the distance remaining between the plane defined by the narrow side edges of upright posts 7 and the plane defined by the surface of a cover board 6 fitted in the central groove of said upright posts. Thus, with fastening piece 22 mounted in position, only said support and runner track 23 or part of it extends beyond the plane defined by the narrow side edge of upright posts 7. Thus, the support and runner guides (grooves, tracks or the like) at the side edges of a drawer extend sufficiently far to cooperate with support and runner tracks 23.

Figure 9:
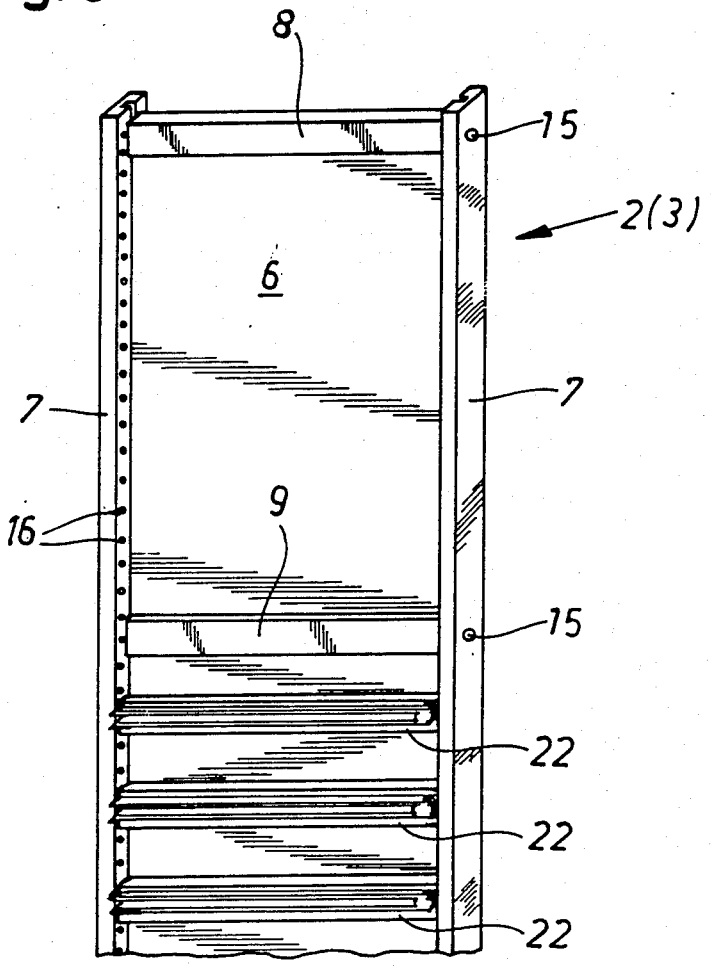

In FIG. 9, the bottom portion of an end ladder 2 (3) is provided with fastening pieces 22, fitted with a support and runner track for a drawer. In the finished cabinet structure, this portion is of course not covered by a door, but only the top portion will be fitted with a door 4. Cabinets and shelves can also be combined side by side in a manner that some of the areas between end ladders are not at all fitted with doors, but only with drawers and shelves on top of each other.

Possible manufacturing materials for frame structures include wood, plastic-coated wood or plastics.

I claim:

1. A collapsible cabinet, comprising end ladder structures which form gables of a cabinet, and door frame structures, both structures including upright posts with broad sides and narrow sides and horizontal braces with broad sides and narrow sides positioned therebetween so that the broad sides of said horizontal braces are oriented in the vertical direction to partly expose the broad sides of the upright posts on either side of the ends of the horizontal braces, said horizontal braces being fastened between the upright posts for keeping said upright posts parallel to and spaced a consistent distance from each other, the horizontal braces and upright posts thus defining rectangular areas, whereby the sides of both of the horizontal braces and upright posts facing such rectangular areas are each provided with a groove for receiving cover boards which cover said rectangular areas, wherein said horizontal braces of said end ladders are fastened between the broad sides of said upright posts by means of screws extending through said upright posts, in addition to which the broad sides of said upright posts are provided with arrays of holes extending on either side of the ends of said horizontal braces.

2. A collapsible cabinet as set forth in claim 1, wherein said rectangular area is defined by the bottom of said grooves in said horizontal braces and said upright posts and is of equal size in said end ladder as in said door frame structure, both of said areas being fitted with cover boards of a single standard size.

3. A collapsible cabinet as set forth in claim 2, wherein said horizontal door braces are fastened between said upright posts by means of screws extending through said upright posts.

4. A collapsible cabinet as set forth in claim 2, wherein prefabricated holes for fastening screws in said end ladder upright posts and in said door frame upright posts are at a same standard distance from each other.

5. A collapsible cabinet as set forth in claim 4, wherein the ends of horizontal braces are provided with prefabricated holes for receiving fastening screws.

6. A collapsible cabinet as set forth in claim 1, wherein a fastening piece, both ends of which are provided with at least one hole or a laterally open recessed area, is fixed between said upright posts by means of pegs fitted in holes of the area of holes in said upright post and in said hole or said laterally open recessed area at the end of said fastening piece.

7. A collapsible cabinet as set forth in claim 6, wherein one end of said fastening piece is provided with at least one hole the other end being provided with at least one laterally open recessed area.

8. A collapsible cabinet as set forth in claim 6 or 7, wherein a support and runner track for a drawer is mounted on said fastening piece.

* * * * *